United States Patent [19]

Curtis

[11] Patent Number: 4,723,609

[45] Date of Patent: Feb. 9, 1988

[54] DOUBLE BLADED COMBINATION SCRAPER

[76] Inventor: Floyd F. Curtis, P.O. Box 404, Post Falls, Id. 83854

[21] Appl. No.: 814,249

[22] Filed: Dec. 30, 1985

[51] Int. Cl.[4] ..... E02F 3/76

[52] U.S. Cl. ..... 172/815; 37/117.5; 37/233; 172/701.3; 15/245; 414/724

[58] Field of Search ..... 172/815, 701.3; 37/117.5, 241, 232, 233, 274, 281, 266, 279; 15/245; 414/724, 428

[56] References Cited

U.S. PATENT DOCUMENTS

| | | | |
|---|---|---|---|
| 520,479 | 5/1894 | Bunnell | 172/701.3 |
| 896,394 | 8/1908 | Kindred | 15/245 |
| 2,061,585 | 11/1936 | Meyer | 172/701.3 |
| 2,577,977 | 12/1951 | Nelson | 414/724 |
| 2,936,537 | 5/1960 | Bain | 37/233 |
| 3,157,099 | 11/1964 | Ulrich | 172/815 |
| 3,424,251 | 1/1969 | Bouley | 172/815 |
| 3,477,149 | 11/1969 | Wagner | 172/701.3 |
| 3,793,752 | 2/1974 | Snyder | 37/241 |
| 3,929,366 | 12/1975 | Keverline | 294/88 |
| 4,051,966 | 10/1977 | Cotton | 414/428 |
| 4,073,532 | 2/1978 | Blair | 414/684 |
| 4,099,578 | 7/1978 | Stevens | 172/815 |
| 4,275,985 | 6/1981 | Schremmer | 414/722 |
| 4,349,323 | 2/1981 | Mathis et al. | 425/147 |
| 4,356,645 | 11/1982 | Hine | 37/281 |
| 4,463,507 | 8/1984 | Gaub | 172/820 |

*Primary Examiner*—Richard J. Johnson

*Attorney, Agent, or Firm*—Keith S. Bergman

[57] ABSTRACT

A scraper for use with a two point bucket hitch of a tractor. The scraper provides a resiliently deformable blade depending below a rigid blade so that the deformable blade might be independently used by regulating blade height above a surface. The scraper has a primary medial blade member with pivotally connected lateral wing blade members on each side, which may be independently moved. The lateral wings releasably carry inwardly projecting tines to releasably engage and support coherent masses of material such as baled hay. A releasably attachable bottom pan converts the blade structure to a bucket. The scraper is particularly adapted to move animal excrement over flat surfaces of agricultural structures for accumulation and remove it therefrom for disposition.

8 Claims, 11 Drawing Figures

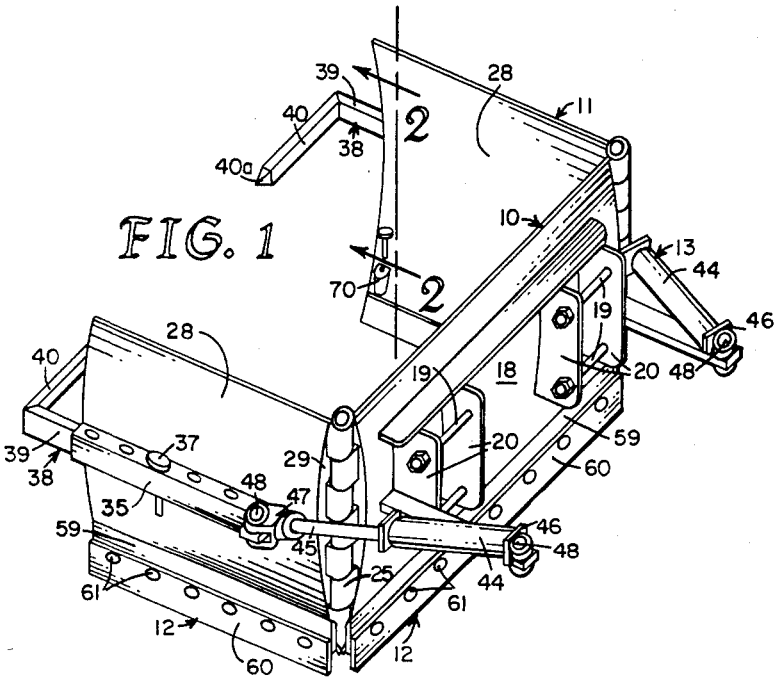
FIG. 1
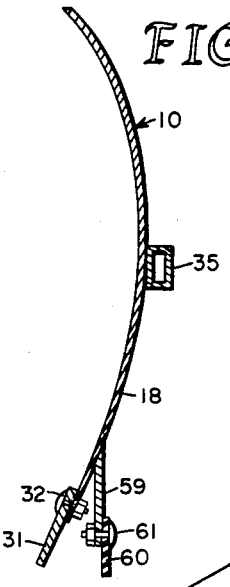
FIG. 2
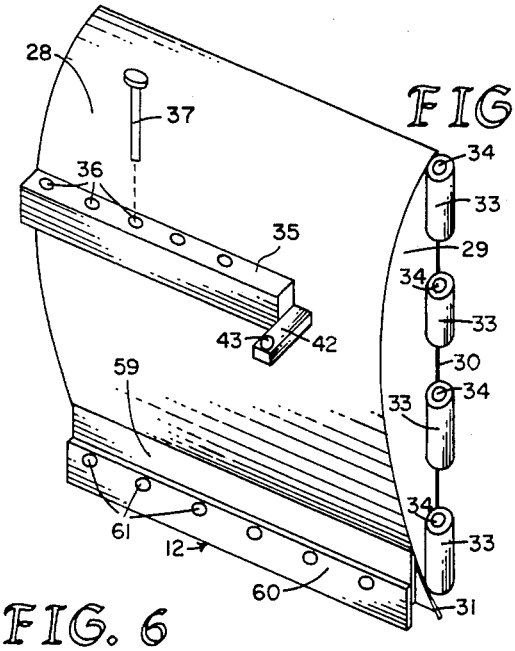
FIG. 3
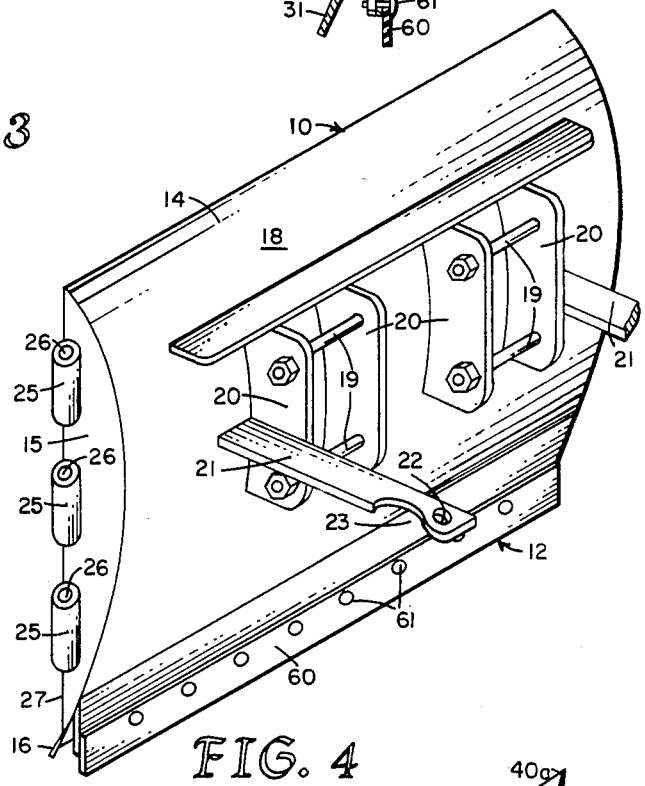
FIG. 4
FIG. 6
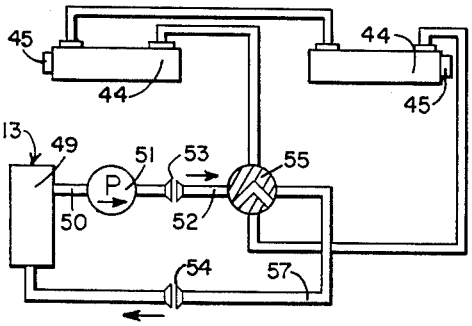
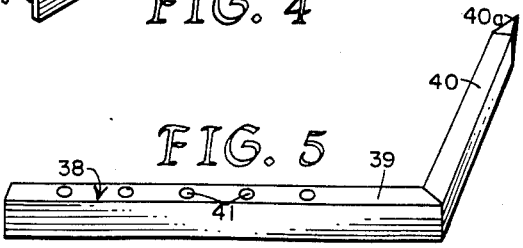
FIG. 5

DOUBLE BLADED COMBINATION SCRAPER

BACKGROUND OF INVENTION

A. Related Applications

There are no applications related hereto heretofore filed in this or any foreign country.

B. Field of Invention

My invention generally relates to scrapers carried by a two point bucket hitch of a tractor and more particularly to such a scraper having both rigid and flexibly deformable scraping blades and releasably attachable auxiliary structures.

C. Description of the Prior Art

In the commercial arts generally, and especially in the agricultural branch thereof, it is often necessary to move substantial quantities of material by some type of scraping action and by reason of this requirement many and various scrapers have heretofore become known. Many of these scrapers have evolved into some sort of ancillary structure or implement, generally of a unified detachable nature, that is attached to and moved by a tractor type vehicle. My invention provides a new member of this class of scraper.

It is often desirable and sometimes necessary to use such scraper blades in dealing with particular materials that may not be amenable to a single type of scraping action. This may result from lack of homogeneity in the material, from various environmental and particularly weather conditions, from dealing with materials in different environs such as on the ground or on a hard uniform surface, from dealing with greater or lesser quantities of material or from other like causes. It also may be necessary to deal with materials by scraping either toward or away from a prime mover and to accommodate these functions a compound scraper with pivotally mounted wing member movable in either direction from alignment with a principal scraper member is required. In the prior art each of these functions generally has been accomplished, if at all, individually by a particular specialized structure adapted only to fulfil the particular function. Scrapers of the prior art generally have not effectively accomplished more than one such function because of their specialized nature. The instant invention seeks to provide a single scraper that will perform all of these functions effectively.

My invention has connecting mechanism for interconnection with the standard two point, so called "bucket hitch", of the common front-end loader or tractor so that the scraper may be used with such existing prime movers without modification of either scraper or prime mover. Many prior art devices have required specialized non-standard fastening and mounting means.

My scraper is of a compound nature, providing a central body pivotally mounting wing members which may be moved to allow scraping in either direction normal to the scraper body's principal surface and yet contain materials in an associated mass for simple collection. Many prior art scrapers either do not provide means to aid in amassing scraped material or to do so they must be moved in only one direction.

My scraper provides two elongate, spacedly adjacent depending blade elements, one rigid and constituting a downward extension of the lower portion of the principal scraper blade, and the other flexibly resilient, at a spaced distance from that rigid blade, and depending somewhat therebelow so that it may be independently used by appropriate vertical positioning of the principal blade. The two blades depend at an angle to each other so that either may be used in a pushing or a pulling scraping action in either direction reasonably normal to the faces thereof. Prior art devices have not provided double bladed scraping elements of differing nature to allow selective scraping action by either.

Each of the pivotal wing members of my scraper may releasably carry "L" shaped line elements with cooperating legs extending inwardly toward each other. These lines may be moved toward or away from each other by motion of the scraper wing members and thereby provide means of engaging a coherent mass of material, such as a bale of hay, for positional maintenance to allow movement, placement or transport. Hay moving elements of the tine type have generally not been associated with scraper structures in the prior art.

A substantially rectilinear bottom pan is provided for releasable attachment to the lower portion of my scraper to allow its use as a traditional agricultural front end loader. In the prior art, where buckets have been provided in combination with a scraper, they have generally not been removable from an associated prime mover and any scraping action has been carried out with the edge of the bucket, neither of which functions are required by my invention.

Various individual features of my invention have heretofore become known per se as indicated, but none of the prior art discloses all of its structural features in the unique synergistic combination herein specified and claimed to produce the functions necessarily produced. Similarly, no element of the prior art discloses how it might be combined with any other elements thereof to form the combination of my invention.

SUMMARY OF THE INVENTION

My invention generally provides a rigid elongate principal scraper member of some vertical height having pivotally mounted lateral wing members movable by hydraulic means carried between the members.

The principal scraper member provides attachment means for interconnection with a two point bucket hitch of ordinary agricultural tractors. The scraper member and wing members each carry a first rigid and a second spacedly related resiliently deformable scraping blade, with the resilient blade depending further than the rigid blade so that it might be independently used. The lateral wing members carry tines extending inwardly toward each other to allow positional maintenance of coherent masses of material therebetween for transport. A releasably attachable bottom may be carried by the lower portion of the scraper and wings to form a traditional "bucket" for containing and moving loose material.

In creating such a device it is:

A principal object to provide a rigid elongate compound scraper that has means of releasable interconnection with two point bucket hitches of existing commercial tractors.

A further object to provide such a scraper that has pivotally mounted, hydraulically movable lateral wing members to aid accumulation of scraped material when scraping action is accomplished in either direction normal to the principal scraper member.

A still further object to provide such a scraper that has both a rigid blade and a spacedly related resiliently deformable blade.

A still further object to provide such two blade structure with the resilient blade depending at an angle to and below the rigid blade for independent use by appropriate vertical positioning of the scraper.

A still further object to provide such a scraper that has tines releasably carried by each wing and extending inwardly toward each other to support coherent masses therebetween.

A still further object to provide such a scraper that has a releasably attachable bottom pan to allow use as a traditional front-end loader bucket to contain and move loose material.

A still further object to provide such a scraper that is of new and novel design, of rugged and durable nature, of simple and economic manufacture and one otherwise well adapted for the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout:

FIG. 1 is an isometric view of my scraper showing its various parts, their configurations and relationship.

FIG. 2 is a somewhat enlarged cross-sectional view through one of the lateral wing members of FIG. 1, taken on the line 2—2 thereon in the direction indicated by the arrows.

FIG. 3 is an isometric view of the back of one of the lateral wing members.

FIG. 4 is a partial isometric view of the back of the principal scraper member.

FIG. 5 is an isometric view of one "L" shaped tine element.

FIG. 6 is a diagram, in normal symbology, of the hydraulic system of my scraper.

DESCRIPTION OF THE PREFERRED EMBODIMENT

Figure 7:
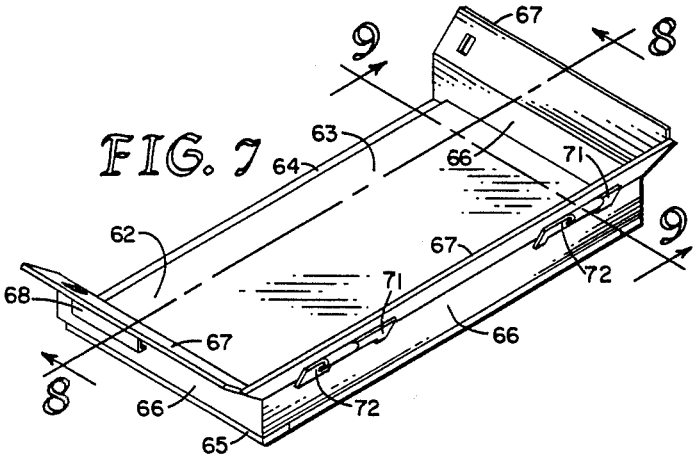
FIG. 7 is an isometric view of the releasably attachable bottom pan, showing its parts, their configuration and relationship.
Figure 9:
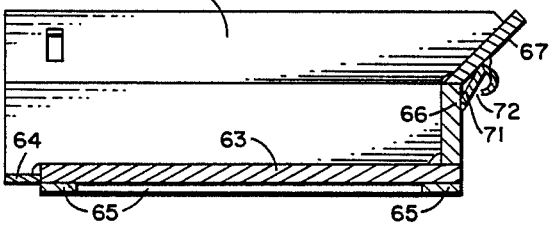
FIG. 9 is a transverse cross-section through the bottom pan of FIG. 7, taken on the line 9—9 thereon in the direction indicated by the arrows.
Figure 8:
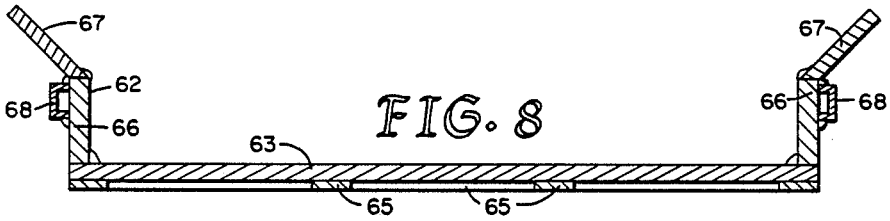
FIG. 8 is an elongate cross-section through the bottom pan of FIG. 7, taken on the line 8—8 thereon in the direction indicated by the arrows.
Figure 10:
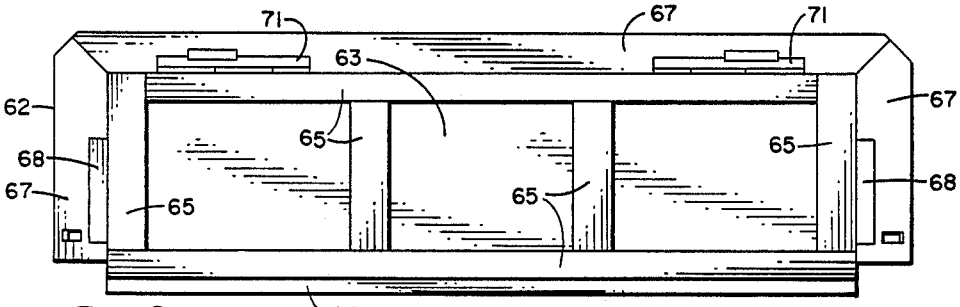
FIG. 10 is a bottom view, looking upwardly at the bottom of the pan of FIG. 7.
Figure 11:
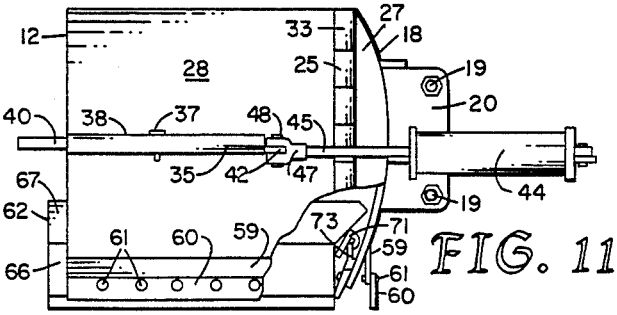
FIG. 11 is an orthographic side view of the bottom pan releasably connected in operative position on my scraper structure.

My invention generally provides primary scraper member 10 pivotally carrying lateral scraper wing members 11 movable by hydraulic means 13 communicating therebetween. The scraper members provide spaced resilient blades 12 depending therebelow for independent use, and releasably attachable tine clements 38 and bottom pan 62.

Primary scraper member 10 provides elongate body 14 with a curvilinear cross-section and planar ends 15 at each of its lateral extensions. The scraper member preferably is formed as an elongate segment of a circular cylinder, substantially as illustrated, and in this type of structure ends 15 will comprise cords of circles cut on a line extending between the top and bottom of the curvilinear blade. These elements are structurally joined at their communicating edges, in the instance illustrated by welding.

The lowermost edge of scraper body 14 carries elongate rigid blade 16, extending downward substantially tangentially therefrom and fastened to the lower portion of the scraper blade by mechanical means, such as by bolting 17 in the instance illustrated. The lowermost portion of blade 16 is configured to present a straight edge that may be positioned against a planar surface therebeneath for scraping action. A detachable rigid blade is preferred for the overall durability of my invention so that the blade might be separately replaced when necessary, as it is an element that suffers wear more than other parts of my scraper. Obviously, however, the scraper body itself might serve the purposes of the rigid blade, if not so effectively.

Convex side 18 of the principal scraper member, which will for convenience and by the convention of operation be referred to as the back, provides means for releasable attachment to an ordinary two point "bucket" hitch of commercial tractors. Such tractor hitches (not shown) are adapted to interconnect with two horizontally spaced sets of two vertically spaced groups of horizontally extending connecting pins 19. The connecting pins of each group are carried by similar vertically oriented, spaced connecting pin brackets 20 that in turn are structurally carried in their forward portion by mechanical attachment to the rearward side of blade body 14 in symmetrical position on each of its medially lateral parts. Normally it is necessary to insert connector pins 19 into journals carried by an interconnecting prime mover by moving them endwise and, because of this requirement, pins 19 are releasably maintained between brackets 20 by releasably positioned end fasteners 21 maintained on each connecting pin's end parts that extend a spaced distance laterally beyond each associated bracket 23. End fasteners 21 may conveniently be ordinary cotter keys or similar, commercially known collars or caps used in the present day mechanical arts to maintain elongate position of shafts relative to their journals.

The convex scraper back carries similar paired elongate rearwardly extending hydraulic brackets 21 in a vertically medial position immediately laterally of each lateralmost connector bracket 20. Each hydraulic bracket must have sufficient lengths to allow an associated hydraulic cylinder, extending therefrom to the scraper wing member, to be operative and clear the lateralmost part of the principal scraper body. Each bracket defines hydraulic cylinder pin hole 22 at a spaced distance from its rearwardmost portion, and in the instance illustrated, defines cylinder slot 23 in its rearward lateral edge to allow clearance of rearward parts of an associated hydraulic cylinder.

Each later end 15 of principal scraper member 14 carries spaced cylindrical hinge elements 25 each defining medial, axially aligned hinge pin holes 26 therein. These hinge elements are positioned and configured to interfit with similar hinge elements carried by each lateral wing member 11 to pivotally join these scraper elements. Hinge elements 25 are so positioned on scraper end 15 that the forward facing straight edge 27 of the end will be substantially adjacent the forwardly facing straight portion of end 29 of a lateral wing member so that the elements form a reasonably continuous surface at their intersection. The hinge elements, for appropriate mechanical operation, must also be so positioned that their pin holes are in axial alignment and their axes parallel to the edge of the ends at which they are connected.

Various structural subframe elements 28 may be added to the scraper structure to increase its strength or rigidity according to principles known in the mechanical structural arts. In general, however, the preferred form of scraper body 14 is formed of sufficiently strong and rigid material that subframe reinforcement is not necessary for ordinary operation.

Lateral wing scraper members 11 are similar structures, one being the mirror image of the other. Each provides primary body 28 of the same vertical height and curvilinear cross-sectional configuration as the primary scrapper body. The inwardmost portion of each wing member provides planar ends 29, structurally communicating with the scraper body, in the instance shown by welding of the adjacent edges. Wing member ends 29 are of the same shape as the prinicipal scraper member ends 15 and provide a straight forwardly facing edge 30 which would be a cord of the circular sector defining the end element.

Each wing member has an elongate, separately formed, rigid blade 31 releasably attached to the lower portion of the scraper blade body 28 by not bolt combinations 32, in fashion similar to that heretofore described for the primary scraper blade. The structure of the wing member blades is substantially the same as that of the primary blade member and all are configured so that they will have the same height, as illustrated particularly in FIG. 1.

End elements 29 of each wing member blade provide plural spaced cylindrical hinge elements 33 positioned and spaced to interfit with the similar elements 25 of the adjacent end portion of the primary scraper member. These hinge elements define similar medial pin channels 34 and the elements are so positioned that the pin channels of all hinge elements of one hinge are in axial alignment. The positioning of these elements is such that when they interfit with the hinge elements of one end of the primary scraper member, the two straight adjacent edges 27, 30 of primary and wing ends are in adjacency. Elongate cylindrical hinge pins 35, of length sufficient to extend from the lowermost hinge element to the uppermost, are carried in and through the hinge pin holes 26, 34 to form a hingable interconnection of each scraper wing member 11 at each end of primary scraper member 10 and allow pivotable motion of each joined element relative to the other.

Each wing member carries, in a vertically medial position, substantially parallel with its bottom edge, rectilinear tine channel element 35 which is structurally joined to convex side or back of the wing member, preferably by welding. This element is formed of channel steel of rectilinear cross-section and has an open end facing forwardly. A plurality of paired spaced pin holes 36 are defined in the upper and lower surfaces of the channel to releasably and slidably receive fastening pin 37 extending therebetween. Each tine channel releasably and adjustably carries an "L" shaped tine element 38 having rectilinear body 39, of a cross-sectional configuration adapted to slidably fit in substantial peripheral adjacency within the channel defined by tine channel element 35, and a perpendicular tine 40 structurally communicating with the forwardmost end of the body portion and extending inwardly (toward the opposite wing) therefrom. The inner end portion **40*a* of the tine is pointed to aid insertion within a deformable product mass. A plurality of spaced fastening pin holes 41 are defined vertically, through body 38 of the tine, to receive fastening pin 37 therein to maintain the tine structure in a particular position within tine channel element 35. The dimensioning of the arms of the tine structure is not particularly critical so long as the lines therebetween are of appropriate length to receive and support whatever material might be desired therebetween. Normally the space between points 40*a*** of the two cooperating tines should be several inches less than the length of product that will be carried between them, to allow proper positional maintenance of that product.

The vertically medial portion of the inner part of a scraper wing member 11, on its external or convex side, carries perpendicular laterally extending cylinder arm bracket 42 which defines cylinder pin hole 43 in it outer end part. This bracket is positioned immediately rearwardly of the rearwardmost extension of tine channel 35 so that the two structures may be joined to structurally reinforce each other. The configuration and sizing of the cylinder arm bracket must be such as to allow clearance of a hydraulic cylinder carried between that bracket 42 and cylinder bracket 21 of the primary blade member outside the corner structure therebetween.

The various elements of the primary and wing scraper members heretofore specified are preferably formed of metal to provide appropriate strength, rigidity and durability. The preferred metal of formation is mild steel and with this material the various elements are fixedly joined, where necessary and appropriate, by welding. The dimensioning and configuration of the elements of the scraper strutures are not particularly critical so long as they fulfill the requirements specified for them. In a structure having a primary scraper member of some 6 to 8 feet in length and wing blades somewhat shorter, I prefer to form the blade body from quarter-inch steel plate. Normally with this material no extensive secondary reinforcing frame elements are required to provide necessary strength and rigidity. Such secondary frame elements may be provided, however, and if they are, the sheet material well may be of a somewhat lighter nature.

The hydraulic system of my invention provides double acting hydraulic cylinders 44 with piston shafts 45 extending therefrom. Connecting yoke 46 extends from the end of the cylinder and piston shaft yoke 47 is carried by the outer end of each piston shaft. The hydraulic cylinders are pivotally interconnected between adjacent cylinder brackets 21 carried by the primary scraper member and cylinder arm brackets 42 carried by the adjacent wing scraper member by connecting pins 48 pivotally communicating between cooperating holes defined in these structures. In the instance illustrated, the cylinder connecting yokes are carried by the cylinder brackets of the primary scraper member though obviously the cylinders might be reversed. With this structure then, as a piston shaft 45 moves inwardly or outwardly, the interconnected scraper wing member will be moved pivotably relative to the principal scraper, forwardly upon extension and rearwardly upon contraction.

The operative elements of the hydraulic system are shown symbolically in the illustration of FIG. 6. Reservoir 40 provides a supply of hydraulic fluid which passes through line 50 to pump 51 where it is pressurized and passed through line 52 serving as a manifold for the operative hydraulic elements. Normally the pump and reservoir portion of the hydraulic system is provided by the existing hydraulic system of a propelling vehicle (not shown). If so, the existing hydraulic lines of the propelling vehicle are interconnected by connectors 53 on the pressure side and connector 54 on the return side. Line 52 is controlled by valve 55 which passes pressurized fluid to cylinders 44 which are interconnected in series with each other in the hydraulic system. Each cylinder is serviced on the return side by common return line 57 which communicates to connector 54 and thence to reservoir 49. Hydraulic cylinders 44 are double acting and valve 55 is a two position valve to allow the wing blades to be pivoted under power in either direction. Normally control valve 55 will be physically positioned in or on a propelling vehicle for simplicity and ease of operation.

Secondary flexible blade structure 12 is shown in detail in the cross-sectional view of FIG. 2. The flexible blade structure of each scraper member is substantially identical except for length, that is, its longer dimensions in a horizontal plane.

Elongate rigid blade connecting flange 59 is structurally carried by the lower convex or rearward side of each blade, parallel to and at a spaced distance above its lowermost portion. This flange is of the same horizontal length as the scraper blade member carrying it and is structurally interconnected with that member, as in the case illustrated by welding the adjacent edges. This blade connecting flange supports and positionally maintains elongate, sheet-like, resiliently deformable blade 60, releasably interconnected with the connecting flange by mechanical means, as in the form illustrated by a plurality of spaced nut-bolt combinations 61 extending between overlapped portions of the two elements. This interconnection of flexible blade and blade connecting flange may take various forms other than that illustrated and remain within the spirit of my invention, as the only requirement is that the elements be interconnected in some fashion that structurally and positionally maintains them. The lapped joint could allow adjacent surfaces of the elements to be adhered for permanent joinder. Various types of molding structures, especially of the mortise type, may be used for either permanent or releasable joinder. Interconnecting metal bands might be placed on the surface of the flexible blade horizontally most distal from the connecting flange to further protect and strengthen the flexible blade especially at its points of interconnection. Preferably the interconnection is releasable so that flexible blades might be replaced when they wear, as they commonly do not have too long a life and not nearly so long a life as other parts of my scraper.

The flexible blade is formed of some resiliently deformable material which has reasonable strength, some elasticity and preferably a deformable memory so that if fairly well assumes its shape within a short time after deformation during that use. The blade must have appropriate resiliency to allow it to act in a so called "squeegee" fashion in moving and collecting material that cannot be readily moved or collected by a rigid blade, especially fluid or semifluid materials and particularly excrement of animals.

The sizing and dimensioning of the flexible blade is somewhat critical, particularly in its relationship to the scraper structure which carries it. The flexible blade must extend downwardly, relative the bottom portion of the associated rigid blade 31, some distance further than the lowermost extension of that rigid blade. This amount of downward extension may vary within a range, but normally it should be about one to two inches to allow independent use of the flexible blade. Again, the amount of flexible blade extension below blade connecting structure 59 must be such as to allow some flexibility for proper squeegee type operation of the blade.

It is to be noted from the structures described, that since both the blade connecting flange and associated flexible blade extend vertically downwardly from interconnection with the convex side of the scraper blade member, those elements will be at a spaced distance, in a direction normal to the blade member, from the associated rigid blade 31 which extends substantially langentially from the curvilinear blade. This configuration allows appropriate deformable motion of the flexible blade to allow it to serve its intended purposes.

Normally I prefer to form a flexible blade of material specifically created for industrial blades of the squeegee type, such as a fabric or metal reinforced polymeric or elastomeric sheet material. Normally unreinforced homogenous structures of either rubber or plastic alone are not sufficiently durable and do not provide appropriate strength, rigidity or durability. Ordinary reinforced machine helting of approximately three-quarters to one inch thickness serves the purpose of my invention admirably, as do several commercially available reinforced sheet plastics, especially those of elastomeric nature.

If bolt-nut combinations be used to fasten flexible blade 60 to blade connecting flange 59, those bolts should have oversized heads on the flexible blade contacting surface or should be provided with washers of substantial size to provide a contact area of sufficient size to aid in avoiding tearing or other physical damage to the flexible blade material.

It should be noted that normally the strength and durability of either a rigid or a flexible scraper blade, if held by a lap joint, will be greater if that blade be used in an operative direction Loward the exposed upper portion of the blade element. To accomplish this, the blade elements may be positioned on either side of their supporting flange as desired. In the form illustrated, the rigid blade would be most effective if operated primarily in a forward direction and the resiliently deformable blade would be most effective if operated in a rearward direction, though both motions may be accomplished, if not with the same effectiveness, in either direction.

Bottom pan 62 of my invention comprises the auxiliary, releasably attachable structure illustrated in FIGS. 7, et seq. The pan provides planar bottom 63 defining acute forward edge 64 and carrying spacedly arrayed strips 65 on its bottom to add strength and rigidity and maintain the bottom element at a spaced distance above a surface therebelow. The peripheral configuration and sizing of the a longer dimension or width substantially the same as that of the principal blade of my scraper and a shorter dimension or length slightly greater than the linear dimension of the wing blades of my scraper.

The back and both side edges of the bottom pan carry vertically upstanding sides 66 with outwardly flaring upper portions 67 to provide a pan-like structure open at its forward edge. The sides are structurally joined to the bottom immediately inwardly adjacent its periphery and each of the adjacent side elements are joined to each other by mechanical means, normally welding. The angle of the upper flaring portion of the side walls is such that when the bottom pan is carried by the properly positioned blade members, those upwardly flaring portions are substantially coincident with the portions of the blades laterally adjacent thereto.

The forward portion of each side wall of the bottom pan carries a bracket 68 to releasably interfit with bracket 69 carried by the forward inner part of each wing blade member to receive headed pin 70 therebetween to releasably fasten these brackets to each other. The rearward side of the pan provides bracket 71 defining vertical slot 72 to releasably and fastenably accept flange 73 carried by the concave face of the principal blade. With this structure, the bottom pan may be positioned in and releasably carried by the scraper structure when that structure be configured with the wing members extending substantially perpendicularly forwardly from the principal blade member and when the structures be so configured and fastened, they will operate as an ordinary front end bucket.

Having thusly described the structure of my invention, its operation may be understood.

Firstly, a scraper structure is formed according to the foregoing specification and attached for operative support on the connecting structure of a tractor type propelling vehicle (not shown). The hydraulic system of the scraper is attached to the operating hydraulic system of the propelling vehicle. In this condition the scraper is ready for use. Normally, it will be carried forwardly of a propelling vehicle, though some vehicles having two point bucket hitches may provide such structures either in the front or the rear. My invention is operable in either position, though probably more conveniently operable in the forward position.

When the scraper is positioned in the area desired for service, it is lowered to a surface contacting position or a position immediately thereabove. If it be desired to service the area with the flexibly resilient blade, that blade is lowered until its lowermost portion is upon the surface therebeneath that is to be scraped. When the scraper be in this position it is to be noted that the rigid scraper blade will be a spaced distance above the surface to be scraped, by reason of the difference in downward projection of the two blades.

If it be desired to use the rigid blade, the scraper is lowered by its carrying tractor until the rigid blade is immediately upwardly adjacent the surface to be serviced. In this instance, the flexible blade will flex and deform sufficiently to allow this positioning.

After the blade is appropriately positioned, it is manipulated in a forward or rearward direction by the propelling vehicle as desired to scrape material resting on the underlying surface being serviced for collection, disposition, accumulation, or other purpose. The scraping action itself is not remarkable and is of the same nature as that heretofore used with such devices.

If it be desired to scrape material for accumulation in a mass, commonly the wing scrapers will be angled in the direction toward which it is desired that the mass be accumulated. The angled wing scrapers will tend to maintain material being operated upon in front of the principal scraper blade member and as material moves laterally along that member it will be returned by the angled wing scraper member to a position in front of the principal blade member, as is traditional with wing scrapers heretofore known. Wing members are moved to a desired angle by manipulation of the hydraulic control valves associated with the hydraulic cylinders that responsively move the wing.

If it be desired to use my implement to move or transport a coherent mass, such as baled hay, the tine elements are positioned in the wing members and those members are opened, or pivoted laterally outwardly at each end. The implement is then positioned with the material to be transported forwardly of the medial portion of the principal blade member and in a position where it will be contacted along a line of substantial mass by the tine elements when they move toward each other. With the material in such position, the hydraulic valves are operated to move the wing blade members carrying the tine elements inwardly toward each other until contact be made with the mass therebetween and the tines become embedded in it. When the tines are so embedded, the mass may be picked up by manipulation of the two point bucket arms of the propelling vehicle and thereafter transported as desired. The mass is released by pivotally moving the wing blade members away from each other until the tines carried thereby be disengaged sufficiently from the mass to release it.

The auxiliary bottom pan is attached to my scraper structure by moving that structure so that the rearward portion of the pan rests immediately forwardly adjacent the forward or concave surface of the principal scraper blade member. The rearward portion of the pan is then raised slightly and brackets 71 engaged upon flanges 73 carried respectively by the adjacent portions of the two structures. The lateral wing blade members are then moved inwardly toward each other until they are positioned immediately laterally adjacent the opposed sides of the bottom pan and in this position, the lateral pan brackets 68 are releasably fastened to the lateral wing brackets 69 by headed pins 70. The pan is then releasably supported by the scraper structure and the entire assemblage may be used as an ordinary bucket for collection, disposition and transport of loose, unconsolidated materials. The bucket may be readily released as desired by the reverse of the process described.

It is to be noted that in using the pan with my scraper, its particularly shaped, flared sides will tend to support it in the scraper blade structure against gravity displacement so long as pan motion be constrained so that it may not move horizontally relative to the blade structure as restricted by the fastening brackets.

It is to be further noted from the foregoing description that my scraper may be used as either a rigid or flexible bladed scraper and may be used in intermediate positions where each of its blade elements are somewhat operative, all by adjusting the vertical position of the device relative to an underlying surface to be operated upon. It is further to be noted that the vertical adjustment of the scraper relative to an underlying surface may be simply, quickly and accurately accomplished by the normal operating mechanism of a tractor supporting it, by means of the two point type bucket hitch.

It is further to be noted that my invention is particularly adapted to handle nonhomogeneous material, such as animal excrement, especially during periods when various portions of such material can be differentially frozen or dried. In such situations the rigid blade may be adjusted to a position immediately above a surface being cleaned and at the same time the flexible blade will be deformed to have a squeegee type action, but one more severe than a normal squeegee because of the deformation of the blade, all to simply and efficiently clean such debris from a supporting surface.

It is to be further noted that by reason of the configuration and construction of my scraper, and particularly the pivotably movable lateral wing members, it may be readily adapted for use with ancillary structures. The tine structures provide a ready means of moving coherent masses of material, particularly baled material such as hay, straw or the like. My auxiliary bottom pan structure converts my scraper into an ordinary bucket-type device such as has heretofore been known and commonly used to move loose, unconsolidated masses of material. These two auxiliary structures allow use of my invention to accomplish many functions that cannot be accomplished by an ordinary known scraper.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. A scraper having both flexible and rigid scraping blades, comprising, in combination:

an elongate primary scraper blade member having a vertically curving shape terminating in a linear bottom edge, similar planar ends terminating on a line between the top and bottom edges of the scraper blade member, means for releasable interconnection with a two point bucket hitch of a propelling vehicle, and means for pivotally interconnecting lateral wing scraper members at each lateral end thereof;

similar opposed lateral wing scraper blade members, each having cross-sectional shape similar to the cross-sectional shape of the primary scraper blade, as inner end terminating on a cord between the top and bottom edges of said wing blade, and means for pivotally interconnecting respective said wing members to one lateral end of the primary scraper blade;

hydraulic means communicating between each lateral end portion of the primary scraper blade member and the laterally adjacent wing scraper blade member to pivotally move the wing scraper blade member relative to the primary scraper blade member; and flexible blade structure including an elongate blade connecting flange depending vertically from the lower portion of the convex side of each scraper blade, said connecting flange releasably carrying an elongate resiliently deformable blade depending therefrom and terminating in a linear edge substantially parallel to and a spaced distance below the bottom scraping edge of the associated scraper blade member, the bottom edges of all resilient blades being substantially co-planar.

2. The invention of claim 1 further characterized by:

each scraper blade member having an elongate, releasably interconnected, rigid blade element extending tangentially downwardly therefrom, the lower edge of each said rigid blade being linear and all rigid blade elements having coplanar bottom edges a spaced distance above the bottom edges of the resilient blades.

3. The invention of claim 1 further characterized by:

each wing scraper blade member having means to releasably and adjustably interconnect "L" shaped tine elements each having a fastening arm extending forwardly from each wing scraper blade member, with perpendicular tine elements extending inwardly a spaced distance toward each other so that said tine elements may engage a coherent mass of material therebetween for positional maintenance and transport.

4. The invention of claim 1 further characterized by:

a rectilinear bottom pan defining a front scraper edge and having outwardly flaring sides extending upwardly from its side and rear edges to conformably fit within the scraper blade structure when that structure be positioned with lateral wing blade members extending perpendicularly forward from the principal blade member, and means of releasably fastening the bottom pan to the adjacent scraper blade members.

5. A scraper structure having both a rigid blade and a spacedly adjacent flexibly resilient blade, comprising, in combination:

an elongate primary scraper blade member constituting a horizontally orientated, axially parallel sector of a cylinder with similar opposed flat ends extending to a line between the upper and lower edges of the primary scraper blade member, said primary scraper blade member having means for releasable interconnection with a two point bucket hitch of a tractor, means for pivotally interconnecting wing blade members to each end of said primary scraper blade, and means for releasably interconnecting an elongate rigid scraper element to the lower portion of the primary scraper member, said rigid scraper element depending a spaced distance therebelow to terminate in a linear lower edge;

two similar wing scraper blade members of substantially the same cross-sectional configuration as the primary scraper member but of shorter length, each said wing scraper blade member having a flat end structure in its inner end similar to the end structure of the primary scraper blade member adjacent thereto and, hinge means for pivotally interconnecting the end of each wing scraper member to the adjacent end of the primary scraper blade member;

hydraulic means extending from the convex sides between each lateral end portion of the primary scraper blade member and the laterally adjacent wing scraper blade member to pivotally move each wing member relative to the primary member, and a flexible blade, carried by the lower portions each scraper blade member, having an elongate sheet-like blade flange structurally depending from the lower portion of the convex side of each scraper blade member at a spaced distance upwardly from its lower edge, an elongate sheet-like flexibly resilient blade releasably carried by the blade flange and depending therefrom to a spaced distance vertically below the lower lineal edge of the scraper blade element of the associated scraper member, and means for releasably interconnecting the flexible blade to the blade flange.

6. The invention of claim 5 further characterized by:

each wing scraper blade member carrying an "L" shaped tine element having a body extending forwardly from the wing scraper blade member a spaced distance with perpendicular tines carried thereby extending inwardly a spaced distance toward each other.

7. The invention of claim 5 further characterized by:

a rectilinear bottom pan defining an acute front edge of the same length as the principal scraper blade member with outwardly flaring sides extending upwardly from its side and back edges to conformably fit against the blades of the scraper structure when adjacent the concave sides thereof, and means of releasably fastening the bottom pan to the adjacent scraper blades.

8. In a scraper structure of the type having a curvilinear sheet-like scraper blade with a lower linear rigid scraping surface, the invention comprising an associated flexibly resilient blade structure including, in combination:

a rigid substantially planar elongate blade connecting flange immovably carried by the convex side of the scraper blade, having its lower edge parallel to and at a spaced distance above the lowermost scraping edge of the rigid blade, and an elongate, resiliently deformable blade releasably carried by the rigid blade connecting flange laterally coextensive with the rigid scraping surface and extending a spaced distance downwardly therefrom to terminate in a lineal edge parallel to and a spaced distance below and horizontally from the lower edge of the associated rigid scraper blade.

* * * * *